US005234578A

United States Patent [19]

Stine et al.

[11] Patent Number: 5,234,578

[45] Date of Patent: Aug. 10, 1993

[54] FLUIDIZED CATALYTIC CRACKING PROCESS UTILIZING A HIGH TEMPERATURE REACTOR

[75] Inventors: Laurence O. Stine, Western Springs; Charles L. Hemler, Mount Prospect; Carlos A. Cabrera, Northbrook; David A. Lomas, Barrington, all of Ill.

[73] Assignee: UOP, Des Plaines, Ill.

[21] Appl. No.: 766,498

[22] Filed: Sep. 26, 1991

Related U.S. Application Data

[63] Continuation-in-part of Ser. No. 236,817, Aug. 26, 1988, abandoned.

[51] Int. Cl.[5] ..... C10G 11/00

[52] U.S. Cl. ..... 208/113

[58] Field of Search ..... 208/113; 422/144, 145

[56] References Cited

U.S. PATENT DOCUMENTS

| | | | |
|---|---|---|---|
| 3,133,014 | 5/1964 | Cross, Jr. | 208/348 |
| 3,221,076 | 11/1965 | Frey et al. | 260/683 |
| 3,238,271 | 3/1966 | Nonnenmacher et al. | 260/683 |
| 3,290,405 | 12/1966 | Von Rosenberg | 260/683.2 |
| 3,661,799 | 5/1972 | Cartmell | 502/43 |
| 4,234,411 | 11/1980 | Thompson | 208/74 |
| 4,243,514 | 1/1981 | Bartholic | 208/921 |
| 4,256,567 | 3/1981 | Bartholic | 208/252 |
| 4,263,128 | 4/1981 | Bartholic | 208/91 |
| 4,459,203 | 7/1984 | Beech et al. | 208/113 |
| 4,479,870 | 10/1984 | Hammershaimb et al. | 208/164 |
| 4,624,771 | 11/1986 | Lane et al. | 208/74 |
| 4,624,772 | 11/1986 | Krambeck et al. | 208/95 |
| 4,820,404 | 4/1989 | Owen | 208/159 |
| 4,822,761 | 4/1989 | Walters et al. | 502/38 |

*Primary Examiner*—Theodore Morris
*Assistant Examiner*—Walter D. Griffin
*Attorney, Agent, or Firm*—Thomas K. McBride; John G. Tolomei

[57] ABSTRACT

The simultaneous use of lift gas in a riser zone that, operates above 975° F. (525° C.) and directly transfers catalyst and hydrocarbons to a series of cyclone separators, the stripping of spent catalyst in a heated stripper zone for the recovery of additional hydrocarbon vapors, and the immediate quenching of a converted hydrocarbon feed upon leaving a cyclone separator raises the octane and product yield in an FCC process. The process uses the specific steps of passing regenerated catalyst particles into the lower section of a substantially vertical riser conversion zone at a temperature greater than 975° F. and accelerating the particles up the riser by contact with a lift gas comprising $C_3$ and lighter hydrocarbons to a velocity of at least 1.2 meters per second. A series of injection nozzles introduce the feed into the moving catalyst in an upper portion of the riser in an amount that will maintain an average temperature of at least 520° C. in the riser. Average hydrocarbon residence time in the riser is between 0.5 to 5 seconds. In order to suppress further conversion and thermal cracking, the converted feed and catalyst can be mixed with a diluent and transferred directly to cyclone separators. A hot stripper zone volatilizes additional carbons absorbed on the surface of the catalyst separated by the cyclone separators. Converted feed hydrocarbons leaving the cyclone separators are immediately contacted with a quench liquid and quenched to a temperature below that at which thermal cracking can occur. The process of this invention can also use catalyst to provide heat input for the stripping zone and a hydrogen environment in the stripper to suppress condensation reactions which would reduce the product yield and increase the coke production in the process. Another variation of the process uses a superadjacent quench chamber that immediately receives separated product vapors directly from the cyclone separators.

9 Claims, 1 Drawing Sheet

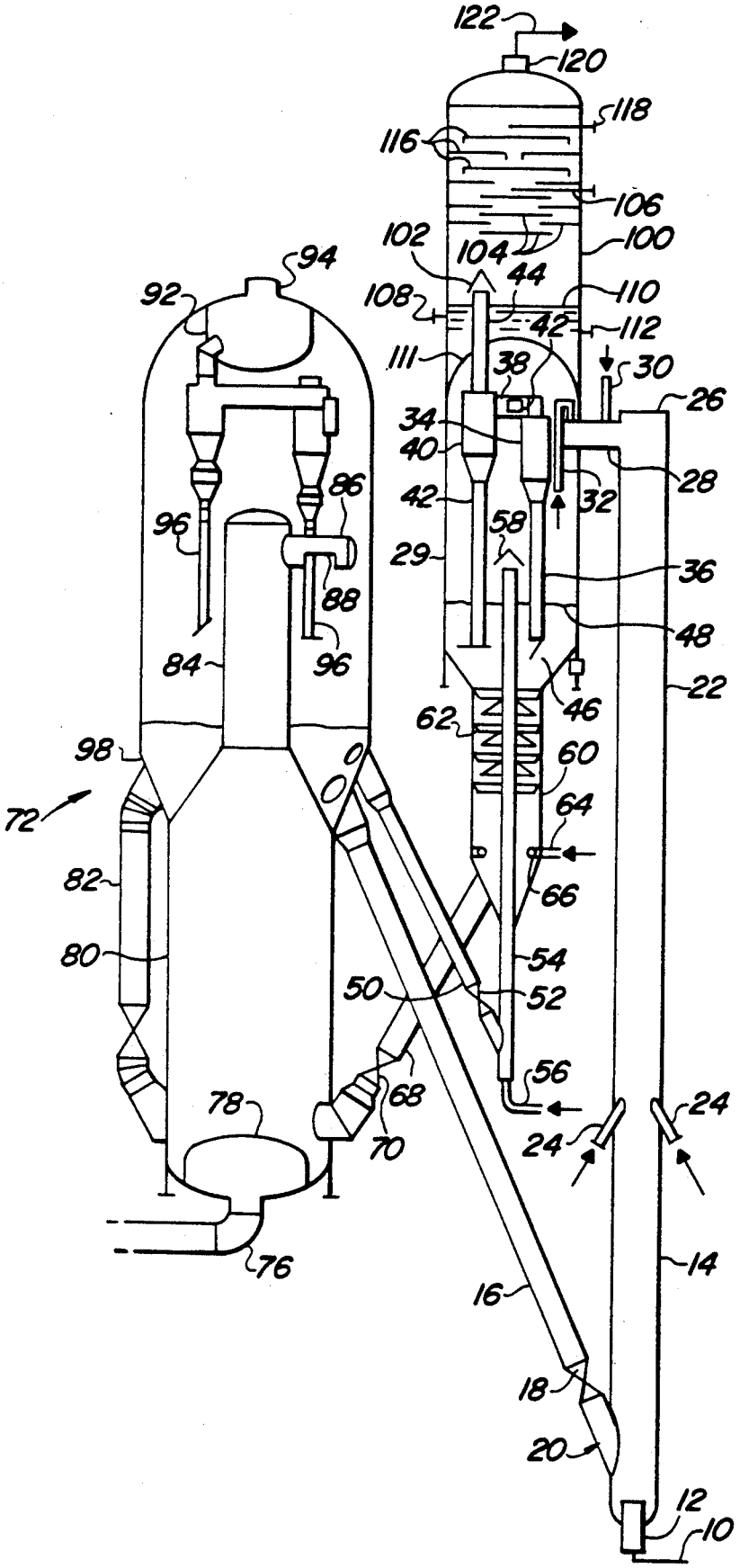
122
120
118
116
106
102
104
100
44
94
92
108
110
42
112
111
38
30
26
34
40
28
42
32
86
58
96
29
36
88
48
84
96
46
22
62
98
60
72
64
82
66
80
54
50
52
56
78
68
24
70
24
76
14
16
18
20
12
10

FLUIDIZED CATALYTIC CRACKING PROCESS UTILIZING A HIGH TEMPERATURE REACTOR

CROSS-REFERENCE TO RELATED APPLICATIONS

This application is a continuation-in-part of U.S. Ser. No. 236,817, filed Aug. 26, 1988, now abandoned.

FIELD OF THE INVENTION

This invention relates generally to processes for the fluidized catalytic cracking of heavy hydrocarbon streams such as vacuum gas oil and reduced crudes. This invention relates more specifically to a method for reacting hydrocarbons in an FCC reactor and separating reaction products from the catalyst used therein.

BACKGROUND OF THE INVENTION

The fluidized catalytic cracking of hydrocarbons is the main stay process for the production of gasoline and light hydrocarbon products from heavy hydrocarbon charge stocks such as vacuum gas oils. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking (hereinafter FCC) of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with steam or another stripping medium. The FCC process is carried out by contacting the starting material whether it be vacuum gas oil, reduced crude, or another source of relatively high boiling hydrocarbons with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. During the cracking reaction, coke will be deposited on the catalyst. Coke is comprised of hydrogen and carbon and can include other materials in trace quantities such as sulfur and metals that enter the process with the starting material. Coke interfaces with the catalytic activity of the catalyst by blocking active sites on the catalyst surface where the cracking reactions take place. Catalyst is transferred from the stripper to a regenerator for purposes of removing the coke by oxidation with an oxygen-containing gas. An An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The rate of conversion of the feedstock within the reaction zone is controlled by regulation of the temperature of the catalyst, activity of the catalyst, quantity of the catalyst (i.e., catalyst to oil ratio) and contact time between the catalyst and feedstock. The most common method of regulating the reaction temperature is by regulating the rate of circulation of catalyst from the regeneration zone to the reaction zone which simultaneously produces a variation in the catalyst to oil ratio as the reaction temperatures change. That is, if it is desired to increase the conversion rate an increase in the rate of flow of circulating fluid catalyst from the regenerator to the reactor is effected. Since the catalyst temperature in the regeneration zone is usually held at a relatively constant temperature, significantly higher than the reaction zone temperature, any increase in catalyst flux from the relatively hot regeneration zone to the reaction zone affects an increase in the reaction zone temperature.

The hydrocarbon product of the FCC reaction is recovered in vapor form and transferred to product recovery facilities. These facilities normally comprise a main column for cooling the hydrocarbon vapor from the reactor and recovering a series of heavy cracked products which usually include bottom materials, cycle oil, and heavy gasoline. Lighter materials from the main column enter a concentration section for further separation into additional product streams.

As the development of FCC units has advanced, temperatures within the reaction zone were gradually raised. It is now commonplace to employ temperatures of about 525° C. (975° F.). At higher temperatures, there is generally a loss of gasoline components as these materials crack to lighter components by both catalytic and strictly thermal mechanisms. At 525° C., it is typical to have 1% of the potential gasoline components thermally cracked into lighter hydrocarbon gases. As temperatures increase, to say 1025° F. (550° C.), most feedstocks can lose up to 6% or more of the gasoline components to thermal cracking.

One improvement to FCC units, that has reduced the product loss by thermal cracking, is the use of riser cracking. In riser cracking, regenerated catalyst and starting materials enter a pipe reactor and are transported upward by the expansion of the gases that result from the vaporization of the hydrocarbons, and other fluidizing mediums if present upon contact with the hot catalyst. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds. A number of riser reaction zones use a lift gas as a further means of providing a uniform catalyst flow. Lift gas is used to accelerate catalyst in a first section of the riser before introduction of the feed and thereby reduces the turbulence which can vary the contact time between the catalyst and hydrocarbons.

In most reactor arrangements, catalysts and conversion products still enter a large chamber for the purpose of initially disengaging catalyst and hydrocarbons. The large open volume of the disengaging vessel exposes the hydrocarbon vapors to turbulence and backmixing that continues catalyst contact for varied amounts of time and keeps the hydrocarbon vapors at elevated temperatures for a variable and extended amount of time. Thus, thermal cracking can again be a problem in the disengaging vessel. A final separation of the hydrocarbon vapors from the catalyst is performed by cyclone separators that use centripedal acceleration to disengage the heavier catalyst particles from the lighter vapors which are removed from the reaction zone.

In order to minimize thermal cracking in the disengaging vessel, a variety of systems for directly connecting the outlet of the riser reactor to the inlet of a cyclone are suggested in the prior art. Directly connecting the cyclone inlet to the riser outlet in what has been termed a "direct coupled cyclone system" requires a means for relieving pressure surges that can otherwise overload the cyclones and cause catalyst to be carried over into the product stream separation facilities located downstream of the reactor. The development of these systems to handle the overload problem in a variety of ways increases the practicality of directly coupling the riser outlet to the cyclone inlet. Direct coupling of cyclones can greatly reduce thermal cracking of hydrocarbons.

It is also known, for purposes of controlling thermal cracking, to lower the temperature of the reaction products upon leaving the cyclone separators by the use of a quench liquid. Quenching the product stream reduces its temperature below that at which thermal cracking can occur and reduces the loss of gasoline products by continued cracking to light ends.

DISCLOSURE STATEMENT

U.S. Pat. No. 4,624,771, issued to Lane et al. on Nov. 25, 1986, discloses a riser cracking zone that uses fluidizing gas to pre-accelerate the catalyst, a first feed introduction point for injecting the starting material into the flowing catalyst stream, and a second downstream fluid injection point to add a quench medium to the flowing stream of starting material and catalyst.

U.S. Pat. No. 4,624,772, issued to Krambeck et al. on Nov. 25, 1986, discloses a closed coupled cyclone system that has vent openings, for relieving pressure surges, that are covered with weighted flapper doors so that the openings are substantially closed during normal operation.

U.S. Pat. No. 4,234,411, issued to Thompson on Nov. 18, 1980, discloses a reactor riser disengagement vessel and stripper that receives two independent streams of catalyst from a regeneration zone.

U.S. Pat. No. 4,479,870, issued to Hammershaimb et al. on Jun. 30, 1984, and U.S. Pat. No. 4,822,761, issued to Walters et al. on Apr. 18, 1989, teach the use of lift gas having a specific composition in a riser conversion zone at a specific set of flowing conditions with the subsequent introduction of the hydrocarbon feed into the flowing catalyst and lift gas stream.

U.S. Pat. No. 3,133,014 shows the use of a spray nozzle in a reactor vapor line to cool high boiling hydrocarbons and prevent the formation of coke deposits on the vapor line wall.

U.S. Pat. Nos. 3,290,465; 4,263,128; 4,256,567, and 4,243,514 generally teach the use of quench streams for the purpose of preventing thermal cracking of hydrocarbons in transfer lines.

U.S. Pat. Nos. 3,221,076 and 3,238,271 show the direct transfer of vapors from a cyclone separator in a reaction vessel to a contacting vessel for quenching or removing fine catalyst particles that are transported with vapors.

BRIEF DESCRIPTION OF THE INVENTION

It is an object of this invention to increase the octane barrel yield from an FCC unit.

It is a further object of this invention to provide an FCC process that operates with high reaction temperatures.

It is a yet further object of this invention to provide an FCC process having reduced times of contact between the catalyst and hydrocarbons, and reduced exposure of the hydrocarbon feeds to elevated temperature exposure.

It is a further object of this invention to provide an FCC process that will facilitate the separation of catalyst and hydrocarbon vapors.

It is a yet further object of this invention to improve the recovery of cracked hydrocarbon products from the disengagement zone and stripper section of the reaction process.

These and other objects are achieved by the process of this invention which is an FCC reaction process that converts FCC feed by contact with pre-accelerated catalyst in a riser conversion zone, maintains a short contact time between the catalyst and hydrocarbon feed, utilizes a hot stripper zone to enhance the recovery and desoption of hydrocarbon vapors from the surface of the catalyst, injects recovered hydrocarbon vapors from stripper into the cyclone separators, and rapidly quenches hydrocarbon products recovered from the cyclone separators to avoid thermal cracking.

In a more complete embodiment, this invention is a process for the catalytic cracking of hydrocarbons that comprises passing hot regenerated catalyst into an upstream portion of a riser conversion zone and accelerating the catalyst particles by contact with a lift gas. The lift gas accelerates the catalyst to a velocity of at least 1.2 meters per second before hydrocarbon feed is injected into the riser, at a point downstream from the point of lift gas addition, in an amount that is sufficient to maintain the catalyst and feed mixture at a temperature of at least 520° C. (970° F.) in the riser. The catalyst and hydrocarbons are kept in contact for a period of less than 5 seconds. Catalyst and hydrocarbon vapors are carried by a closed conduit into one or more cyclone separators for separating catalyst from the conversion products. Separated catalyst particles having adsorbed hydrocarbons pass from the separators into a stripping zone. The catalyst passes from the riser to the stripper without substantial cooling so that the stripping zone will operate hot to enhance the removal of hydrocarbons from the particles. Hydrocarbons stripped from the catalyst are returned to the cyclone separators. Conversion products, recovered as a vapor from the cyclone separators, are contacted with a quench medium that reduces the temperatures of the products leaving the separators to a temperature that will substantially prevent thermal cracking of the products.

Other aspects and embodiments of this invention include methods for circulating catalyst between the reactor and a regeneration vessel, methods of recovering products, specific operating temperatures and stream compositions, methods of quenching product vapors, and methods for heating catalyst particles in the stripping zone.

In another aspect, this invention is an FCC reactor apparatus for the catalytic cracking of hydrocarbons. The apparatus includes a substantially vertical riser conversion zone, means for introducing catalyst and lift gas into a lower portion of the riser, means for introducing a hydrocarbon feed into an upper portion of the riser, a transfer conduit in communication with the upper end of the riser at one end and a cyclone separator at the other end, means for relieving pressure surges in the cyclone separator, a catalyst outlet from the cyclone separator communicating with a stripping vessel having a substantial collection volume for receiving catalyst separated by the cyclone. Means are also provided for contacting the catalyst collected in the stripping vessel with a stripping medium. Means can also be provided for contacting the catalyst in the stripping vessel with a heating medium. A gas tube has one end in communication with the stripping vessel and a second end in communication with the transfer conduit. A vapor outlet on the cyclone separator removes hydrocarbon vapors from the separator through a vapor line which is in communication with the outlet for carrying hydrocarbon vapors out of the cyclone separator. The apparatus also includes means for quenching the hydrocarbon vapors before or as they leave the vapor line.

Additional details of the method and apparatus of this invention are set forth in the following detailed description of the invention.

BRIEF DESCRIPTION OF THE DRAWING

The Drawing is a schematic elevation showing in cross-section an FCC reactor suitable for the practice of this invention along with an FCC regenerator.

DETAILED DESCRIPTION OF THE INVENTION

The process and apparatus of this invention will be described with references to the drawing. These references are not meant to limit the process or the apparatus to the particular details of the drawing disclosed in conjunction therewith. Looking first at the operation of the riser conversion zone, a lift gas stream 10 enters an inlet conduit 12 that passes the lift gas into the lower portion of a riser 14. Hot catalyst from a regenerated standpipe 16 passes through a control valve 18 and is mixed with the lift gas in a junction between the standpipe and lower riser generally referred to as a Y-section and denoted as 20 on the FIGURE. Lift gas carries the catalyst up the riser from lower section 14 to upper riser section 22 and conditions the catalyst by contact therewith. Between the upper and lower riser section, feed nozzles 24 inject hydrocarbon feed into the flowing stream of catalyst and lift gas. Hydrocarbon feed is converted as it travels to the end 26 of the riser. At the top 26, the riser ends with an abrupt change of direction that directs the mixture of converted feed components and catalyst into transfer conduit 28.

The catalysts which enter the riser and can be used in the process of this invention include those known to the art as fluidizing catalytic cracking catalysts. These compositions include amorphous clay type catalysts which have for the most part been replaced by high activity crystalline alumina silicate or zeolite containing catalysts. Zeolite catalysts are preferred over amorphous type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, aluminum, or zirconium. These catalyst compositions may have a zeolite content of 30% or more.

Feeds suitable for processing by this invention, include conventional FCC feedstocks or higher boiling hydrocarbon feeds. The most common of the conventional feedstocks is a vacuum gas oil which is typically a hydrocarbon material having a boiling range of from 343°-552° C. and is prepared by vacuum fractionation of atmospheric residue. Such fractions are generally low in coke precursors and heavy metals which can serve to deactivate the catalyst.

This invention is also useful for processing heavy or residual charge stocks, i.e., those boiling above 500° C. (930° F.) which frequently have a high metals content and which usually cause a high degree of coke deposition on the catalyst when cracked. Both the metals and coke serve to deactivate the catalyst by blocking active sites on the catalyst. Coke can be removed, to a desired degree, by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst make-up required to maintain constant activity. The contaminant metals include nickel, iron and vanadium. In general, these metals affect selectivity in the direction of less gasoline and more coke. Due to these deleterious effects, the use of metal management procedures within or before the reaction zone are anticipated when processing heavy feeds by this invention. Metals passivation can also be achieved to some extent by the use of appropriate lift gas in the upstream portion of the riser.

The finely divided regenerated catalyst entering the bottom of a reactor riser leaves the regeneration zone at a high temperature. Where the riser is arranged vertically, the bottom section will be the most upstream portion of the riser. In most cases, the riser will have a vertical arrangement, wherein lift gas and catalyst enter the bottom of the riser and converted feed and catalyst leave the top of the riser. Nevertheless, this invention can be applied to any configuration of riser including curved and inclined risers. The only limitation in the riser design is that it provide a substantially smooth flow path over its length.

Contact of the hot catalyst entering the riser with a lift gas accelerates the catalyst up the riser in a uniform flow regime that will reduce backmixing at the point of feed addition. Reducing backmixing is important because it varies the residence time of hydrocarbons in the riser. Addition of the lift gas at a velocity of at least 1.2, preferably at least 1.8 meters per second is necessary to achieve a satisfactory acceleration of the catalyst. The lift gas used in this invention is more effective when it includes not more than 10 mol % of $C_3$ and heavier olefinic hydrocarbons and is believed to selectively passivate active metal contamination sites on the catalyst to reduce the hydrogen and coke production effects of these sites. Selectively passivating the sites associated with the metals on the catalyst leads to greater selectivity and lower coke and gas yield from a heavy hydrocarbon charge. Some steam may be included with the lift gas and, in addition to hydrocarbons, other reaction species may be present in the lift gas such as $H_2$, $H_2S$, $N_2$, CO, and/or $CO_2$. However, to achieve maximum effect from the lift gas, it is important that appropriate contact conditions are maintained in the lower portion of the riser. A residence time of 0.5 seconds or more is preferred in the lift gas section of the riser, however, where such residence time would unduly lengthen the riser, shorter residence times for the lift gas and catalyst may be used. A weight ratio of catalyst to hydrocarbon in the lift gas of more than 80 is also preferred.

After the catalyst is accelerated by the lift gas, it enters a downstream portion of the riser which is generally the upper section. Feed may be injected into the start of the section by nozzles as shown in the Drawing or any device that will provide a good distribution of feed over the entire cross-section of the riser. Atomization of the feed, as it enters the riser, promotes good distribution of the feed. A variety of distributor nozzles and devices are known for atomizing feed as it is introduced into the riser. Such nozzles or injectors may use homogenizing liquids or gas which are combined with the feed to facilitate atomization and dispersion. Steam or other non-reactive gases may also be added with the feed, for purposes of establishing a desired superficial velocity up the riser. The superficial velocity must be relatively high in order to produce an average residence time for the hydrocarbons in the riser of less than 5 seconds. Shorter residence times permit the use of higher reaction temperatures and provide additional benefits as discussed below; thus where possible the feed has a residence time of 2 seconds or less. In more limited embodiments of this invention, the residence time may be less than 1 second.

The catalyst and feed mixture has an average temperature of at least 520° C. (970° F.). Higher temperatures for the catalyst and feed mixture are preferred with temperatures of 540° C. (1000° F.) and 550° C. (1025° F.) being particularly preferred. The combination of a short residence time and higher temperatures in the riser shifts the process towards primary reactions. These reactions favor the production of gasoline and tend to reduce the production of coke. Furthermore, the higher temperatures raise gasoline octane. The short catalyst residence time within the riser is also important for maintaining the shift towards primary reactions and removing the hydrocarbons from the presence of the catalyst before secondary reactions that favor coke production have time to occur.

The high velocity stream of catalyst and hydrocarbons is then rapidly separated at the end of the riser. This can be accomplished by passing catalyst and hydrocarbons directly into a cyclonic separation system or the riser can be configured so as to abruptly change direction before this initial separation. Following separation, the separated vapors begin their path toward the product recovery zone while the separated catalyst is directed toward the stripping zone.

The catalyst and hydrocarbon stream carried from the riser by transfer conduit 28 can be diluted by the injection of a suitable diluent through a diluent conduit 30. The diluent is mixed with the hydrocarbons and catalyst as they progress through conduit 28. Horizontally arranged transfer conduit 28 carries the hydrocarbons and vapor into a reactor vessel 29. Slightly farther downstream in conduit 28, a stream of separated hydrocarbons, as hereinafter described, enters the top of conduit 28 through a tube 32 which is connected to conduit 28 just ahead of the inlet of a first cyclone separator 34. Hydrocarbon vapor, catalyst, and diluent, when present, pass directly into cyclone separator 34 where separation of catalyst and product vapors occurs. Separator 34 discharging catalyst downwardly through a dip leg 36 and into a hereinafter described stripping zone, while hydrocarbon vapors and small amounts of entrained catalyst are carried from the top of separator 34 through a cross-over conduit 38 and into a second cyclone separator 40. Cross-over conduit 38 contains a weighted flapper door 42 for relieving pressure surges. Cyclone separator 40 performs a more complete separation to recover additional catalyst still entrained in the product vapor. Additional amounts of recovered catalyst are downwardly discharged through a dip leg 42 while hydrocarbon vapors having a very low loading of catalyst particles exit the top of cyclone through an outlet conduit 44.

The diluent that enters transfer conduit 28 will usually comprise steam. Adding diluent ahead of the separation devices lowers the partial pressure of the hydrocarbons as they enter the cyclones. As the catalyst and hydrocarbons pass into the transfer conduits and through the separation devices, turbulence will vary the residence time of the hydrocarbons in these various devices. Therefore, the addition of diluent at this point, to lower the partial pressure of the hydrocarbons, attenuates the effects of catalytic and thermal cracking. Thus, initial contact with a diluent ahead of the cyclones prevents the loss of product by overcracking. Suppressing cracking reactions by the addition of diluent also allows the reaction time to be controlled. As a result, hydrocarbon reactions occur mainly in the riser and, as previously mentioned, can be limited to a short time. Short reaction times again favor the preferred primary reaction mechanism. Reactions that yield the desired distillate and gasoline products are primary reactions that occur quickly. Coke producing secondary reactions, primarily the polymerization and condensation of polycyclic compounds, over the acid catalyst, are secondary reactions that take longer to occur. The polycyclic compounds that combine in these secondary reactions are first generated by primary reactions such as naphthene cracking and the dealkylation of side chains. It is believed that by careful control, a short reaction time allows the primary reactions to occur while preventing most of the secondary reactions. Therefore, the addition of a diluent can increase the production of distillate and raise the quantity and octane of the gasoline product.

However, the addition of diluent through conduit 30 must be limited to avoid condensation of heavier hydrocarbon components in the cyclone separators or transfer conduits and excessive cooling of the catalyst. For this purpose, the temperature of the combined catalyst and hydrocarbon stream should not be reduced below the dew point of the heavier species.

Hydrocarbons separated from the catalyst in a manner hereinafter described are returned to the cyclones to remove any entrained catalyst that may accompany it back into the transfer conduit. For this purpose, the lower end of tube 32 is shown in open communication with the interior of reactor vessel 29. In order to pass hydrocarbons from vessel 29 back into the transfer conduit, a positive pressure must be maintained that will provide the necessary driving force. In order to regulate the pressure drop, these hydrocarbons are transferred back into the transfer conduit through an extended length of gas tube 32. High gas velocities should be avoided since they can impart momentum to the catalyst that will erode the transfer conduit. Gas tube 32 is arranged to direct catalyst into the top of the transfer conduit. The top has the advantage of placing any gas jet developed by the entry of gas into the transfer conduit across the vertical dimension of the transfer conduit which is usually larger than the width of the conduit.

Both tube 32 and diluent conduit 30 also inject gas into the upper surface of the transfer conduit in order to keep catalyst, that tends to flow along the bottom of the conduit, away from the outlets of tubes 32 and conduit 30.

Transfer conduit 28 communicates the catalyst and hydrocarbons with the cyclones that are located within reactor vessel 29. The careful control of reaction times requires that catalyst be communicated in as direct a fashion as possible. The transfer conduit and cyclone arrangement of the drawing differs from a number of those commonly used in the prior art by the direct connection of the transfer conduit to the inlet of cyclone 34. For this reason, transfer conduit 28 can be described as a closed conduit notwithstanding the presence of tube 32 and diluent conduit 30. Since there is a direct connection between the transfer conduit and the cyclone separators, there is, in general, no necessity for locating the separators within a larger vessel. It is, therefore, possible to use cyclone separators that are designed to withstand the internal pressure of the product stream and discharge separated catalyst into a separate stripper vessel which is then vented back to the cyclones.

For the most part, cyclones 34 and 40 are of a conventional design but will generally have a larger capacity, at least in separator 34, for accommodating the larger volume of solids and gases that will enter the cyclones because of the direct coupling of the separator inlet to the transfer conduit. For those units where instabilities in operation, caused by such things as interruption in the flow of catalyst into the riser or the occasional injection of large amounts of water, will cause pressure surges in the riser, provision should be made to prevent these surges from overloading the cyclones. When the cyclone is overloaded, the spiralling effect of the flow through the cyclone that separates particles from fluid, is interrupted and the cyclone to begins to act as a simple conduit transferring large amounts of catalyst out of the top of the cyclone with the converted products. Pressure surges, at least in part, can be relieved by venting the cross-over conduit 38 between the two cyclones.

A preferred method of venting uses a flapper door 42. Flapper door 42 covers an opening on the cross-over conduit that is used for venting excessive pressure from the cyclone and preventing overloading of cyclone 40 when cyclone 34 becomes overloaded with catalyst. Door 42 is weighted to minimize leakage during periods of normal operation when it is not opened by internal pressure in the cross-over conduit. The higher operating pressure inside the reactor vessel also tends to keep door 42 closed. Door 42 can be weighted or alternately counter-balanced such that it will open at a predetermined pressure difference between the internal pressure of cross-over conduit 38 and the reactor pressure outside the conduit. In this case, the venting of cross-over conduit 38 will only project cyclone separator 40, generally referred to as a secondary cyclone, from overloading. It is expected that during the venting operation the amount of catalyst particles leaving the secondary cyclone through conduit 44 will increase, however, this increase for a short period of time will not impair operation of the downstream separation facilities. A similar type vent can be provided on the portion of the transfer conduit located within vessel 29 to also protect cyclone separator 34 from catalyst overload. Additional details on the direct coupling of a riser to cyclones and for protecting the cyclones against overload can be obtained from the previously mentioned prior art.

Dip legs 36 and 42 discharge recovered catalyst into a catalyst stripping section. In the embodiment of the Drawing, dip legs 36 and 42 discharge the catalyst into a relatively dense bed 46 of catalyst particles having an upper bed level 48.

An important element of this invention is the use of a hot catalyst stripping zone. The term "hot catalyst stripping zone" refers to a stripper having a temperature above at least 975° F. Greater advantages are obtained when the stripper is maintained above 1000° F. The high temperature riser operation provides high temperature catalyst that in turn keeps the stripper hot. In many instances, hot catalyst from the separator will have sufficient heat to maintain the necessary stripper temperature.

Where a higher stripper temperature than can be obtained from the riser catalyst is desired, any suitable method may be used to heat the catalyst within the stripping zone. Acceptable methods include the use of heat transfer tubes, controlled oxidation of hydrocarbons in the stripper as well as direct and indirect transfer of heat from regenerated catalyst. One form of indirect heat transfer, to raise the temperature of the spent catalyst, can use a catalyst to catalyst heat exchanger within the stripper that circulates hot catalyst from the regenerator through heat exchange tubes and back to the regenerator in a closed system.

As an alternate approach, in order to impact additional heat into the stripper, the drawing shows a continuous stream of hot catalyst particles being taken from the regenerator by a reheat conduit 50 in an amount regulated by a control valve 52 and transported up a stripper riser 54 by a lift medium, such as steam, that enters the bottom of riser 54 through a conduit 56. Regenerated catalyst particles flow out of the upper end of riser 54 and contact a baffle 58 that redirects the catalyst downward into bed 46. The hot regenerated catalyst heats the spent catalyst particles in bed 46 which are then transferred downward into a stripping vessel 60 having a series of baffles 62 for counter-currently contacting the downward flowing catalyst particles with a stripping medium, such as steam, that enters the stripping zone through a conduit 64 and is distributed over the cross-section of the stripping zone by a distributor 66. Stripped hydrocarbon vapors, as well as stripping medium, rise upwardly through bed 46 and enter the bottom of tube 32 for return to the cyclone separators in the manner previously described. Stripped and fresh catalyst particles are taken from the stripper 60 by a spent catalyst standpipe 68, in an amount regulated by a control valve 70, and transferred to the regenerator for the oxidative removal of coke from its surface.

Catalyst entering the stripper is kept hot to remove additional hydrocarbons from the spent catalyst by vaporizing the higher boiling hydrocarbons from the surface of the catalyst. Since the commonly employed zeolite catalysts can act as an effective adsorbent, a large quantity of hydrocarbons can be absorbed on the surface of the catalyst. Although heating the catalyst will also tend to raise temperatures and again may promote some thermal cracking, any hydrocarbons that remain absorbed on the catalyst are lost by combustion in the regeneration zone. Thus, some small loss to thermal cracking in the stripping zone is preferable to the larger loss of adsorbed product which may be burned in the regenerator.

Any catalyst introduced into the stripper for the purpose of heating should be taken from the hottest section of the regenerator in order to minimize the amount of hot catalyst introduced therein. Although the hot clean catalyst is favored as a heating medium due to its high heat capacity and ready availability, the regenerated catalyst can also act as a clean adsorbent which, if introduced in large quantities, can absorb more additional hydrocarbons than the heat released thereby will desorb from the spent catalyst. Therefore, it is preferable to take relatively small amounts of hot regenerated catalyst from the regenerator for the purpose of heating catalyst in the stripper.

Spent catalyst taken from stripper 60 through spent catalyst standpipe 68 enters an FCC regenerator 72 for the oxidative removal of coke from the surface thereof. A conduit 76 conveys compressed air into a distributor grid 78 that distributes the air over the cross-section of a lower regenerator vessel 80. Regenerated catalyst is carried by a recirculation conduit 82 into lower regenerator vessel 80 and mixed with air from distributor 78 and spent catalyst from conduit 68. Combustion of coke deposits begins as oxygen reacts with coke at the elevated temperature of the catalyst and air mixture. Air and combustion gas carry the catalyst and gas mixture upward into regenerator riser 84. A riser arm 86 having an opening 88 directs the catalyst and gas mixture downward to at least partially disengage gases from the catalyst. The gas mixture plus any entrained catalyst flow upwardly and are collected by cyclone separators 90. A plenum 92 collects combustion gas from the cyclone separators for removal from the regenerator through a nozzle 94. Catalyst recovered from the cyclone separators is discharged through conduits 96 where it is collected by a cone 98 along with catalyst that was initially disengaged by discharge through opening 88. The regenerated catalyst conduit 16 returns regenerated catalyst from cone 98 to riser 14, as previously described. Hot catalyst for reheat conduit 50 is also withdrawn from standpipe 50. Other details and variations on the operation of an FCC regenerator are well known by those skilled in the art.

Looking again at the reactor, converted hydrocarbons that leave separator 40 through conduit 44 undergo quick quenching to avoid thermal cracking. In order to prevent thermal cracking, these vapors will preferably be quenched to a temperature below about 500° C. Quenching may be accomplished by the injection or contact of the vapor stream with a suitable quench fluid. Quench mediums that can be used include light oil, steam, water or heavy oil. When using light oil, stream or water, care must be taken to avoid condensation of higher boiling compounds on the walls of the piping leading to the product separation facilities. These lighter compounds are either used in or easily converted to the gas phase as these light quench materials rapidly cool the higher boiling components of the product stream. The resulting large concentration of gas in the quench stream may not adequately flush coke condensible compounds from the transfer piping. Heavy quench liquids are preferred since they prevent coke accumulation by providing a large volume of liquid wash. Quench liquid may be injected into the converted hydrocarbons using spray nozzles, showered head injection or staged injection of two or more quench mediums. In its simplest form, the quench may be added directly to the cyclone outlets or to a manifold or plenum chamber that collects the hydrocarbon vapors from several cyclone outlets. The Figure shows an alternate form of incorporating the quench medium.

Substantial advantages are achieved in the quench operation when it employs a liquid contacting zone as shown in the Figure. In this type of quench apparatus the quench conduit 44 carries product vapor from each cyclone separator 40 directly into a quench chamber 100. Quench chamber 100 is separated from the reactor by a partition 111. Product vapors entering quench chamber 100 will normally have a temperature in the range of from 480°-565° C. (900°-1050° F.). These vapors leave the end of conduit 60 and travel around an end cover 102. The purpose of end cover 102 is to prevent the quench liquid, as hereinafter described, from spilling back into the conduit 44. In a first series of contacting trays comprising heat removal trays 104, the rising hydrocarbon vapors are contacted by the quench liquid. Heat removal trays 104 are preferably disc and donut trays. At the top of the heat removal trays, a quench liquid is introduced by an extended distributor 106. The quench is preferably a heavy hydrocarbon having a boiling point range of 290°-600° C. (550°-1100° F.). A portion of the liquid quench may also be introduced through nozzle 108 below a liquid level 110 at the bottom of the quench chamber to independently control the temperature of the collected liquid. By the addition of quench liquid, the temperature of the collected liquid may be kept below 400° C. (750° F.) or preferably below 370° C. (700° F.). Maintaining the quench liquid below 400° C. prevents the small degree of hydrocarbon cracking which might otherwise occur at higher temperatures and adversely affect the flash point of the bottoms product. This quench material is generally described as a main column bottoms stream which is obtained from the separation facilities for the product stream and will normally include a slurry of catalyst particles. In new FCC units that use high efficiency cyclones, the main column bottoms carries about 0.01 to 0.05 wt. % catalyst and other insolubles. Older FCC units using a slurry settler will have a much higher wt. % of particulates averaging about 1 to 2%. This quench will usually enter the quench chamber at a temperature in the range of 230°-345° C. (450°-650° F.). A nozzle 112 withdraws liquid quench from the bottom of chamber 100. The nozzle 112 has a location well below the top discharge conduits 44 and should be located as low as possible in the quench chamber in order to keep the full volume of quench liquid in circulation. For this reason, it is also preferable to have several withdrawal nozzles spaced about the circumference of the quench chamber. Temperature of the liquid quench as it is withdrawn through nozzle 112 will be between 315°-400° C. (600°-750° F.). After removal, the quench is normally passed through heat exchange equipment to lower its temperature and pumped back to distributor 106 for return to the top of heat removal trays and to the bottoms quench nozzle 108. The product vapors will also contain a certain amount of heavy material having a boiling point above the entering temperature of the quench medium which will collect and increase the total volume of the quench liquid. Therefore, a portion of the circulating quench medium is withdrawn continuously as heavy oil product to keep the liquid level 110 below the top of conduit 44.

The quench chamber may contain additional contacting trays which receive the lighter product vapors that have risen above trays 104 and are contacted by a hydrocarbon reflux stream that is relatively lighter than the quench medium passed over trays 104. In its preferred form, a second series of contacting trays comprising fractionation trays 116 receive the ascending product vapors while an extended distributor 118 delivers a hydrocarbon reflux stream to the top of the fractionation trays that flows counter-currently to the rising vapors. It is preferred that the reflux stream be a heavy cycle oil having a boiling range of 230°-400° C. (450°-750° F.). As the product vapors enters the fractionation trays, it will usually have a temperature between 275°-400° C. (525°-750° F.). In the case of heavy cycle oil addition, this will usually enter the fractionation trays at a temperature in the range of 260°-320° C. (500°-600° F.). The relatively cool vapors are collected at the top of quench chamber 100 and withdrawn through a nozzle 120. The vapors are carried overhead via line 122 to additional separation facilities for further separation into the various components of the product slate.

Quench chamber 100 and the cyclones are supported from the top of the reactor vessel. In this type of arrangement proper design of partition 111 and discharge conduit 44 is important to the operation of the apparatus of this invention. Partition 111 is designed to withstand a liquid loading on its upper side and a pressure loading on its lower side. The pressure loading results from the higher pressure employed in the reactor vessel relative to the quench chamber provides a driving force for transferring vapors to the quench chamber. The hemispherical shape of partition 111, as shown in the drawing, serves two objectives, one is to withstand the pressure loading on its bottom side when it is greater than the liquid loading on the top side of the partition and to facilitate removal of the bottoms liquid by forming a channel towards the outer periphery of the dome shaped partition. although any shape of partition can be used, it is preferable to avoid a partition that is concave to the quench chamber since this will form a stagnant area of hydrocarbon vapors in upper reactor portion.

Contact of partition 111 with the relatively cool quench liquid on its upper side cools the partition. If the product vapors are allowed to come in contact with the cooled surface, this will promote condensation of the relatively heavy hydrocarbons and the accumulation of coke of the lower surface of the partition. For this reason, a layer of an insulating ceramic material is usually used to cover the entire lower surface of partition 111. This insulating material is composed of an insulating refractory lining having a thickness ranging from 2 to 5 inches depending on the insulating properties of the material. The design and use of such materials is well known to those skilled in the art. Condensation of high boiling product vapors into coke deposits is a similar concern for the discharge conduits 44. The outer surface of conduit 44 is in contact with liquid from the quench and is cooled thereby. An insulating type refractory lining usually covers the inside of discharge conduit 44. In the case of conduit 44, this lining will have a thickness that can vary between 1 to 5 inches depending on the insulating properties of the material. The lining should have a thickness which will keep the surface of the lining that is in contact with the hydrocarbon vapors at a temperature within 9° C. of the vapor temperature in contact therewith.

When the quench chamber is incorporated into the top of the reactor, it can replace a portion of the main column that is generally used separating the recovered vapor products from the reactor. A main column will ordinarily contain a quench section. The incorporation of this invention will allow at least the quench system to be removed from the main column. The embodiment of this invention shown in the Drawing also includes the addition of fractionation trays for the rectification of the vapor leaving the heat removal section. Additional fractionation trays, pump around circuits, and withdrawal points may be added to obtain additional product cuts from the quench chamber.

The unexpected advantages of the FCC arrangement of this invention are demonstrated by the following examples of FCC operations. These examples compare the operation of a conventional FCC operation with the operation of an FCC unit that operates in accordance with this invention. The data for both of these operations are presented in the following case studies which are calculated yield estimates based on simulations that have been developed from pilot plant data and operating data from commercial FCC units.

EXAMPLE 1

In a base case, a feed having a composition as set forth in the Table 1 was charged to a riser and contacted with a low rare earth catalyst having less than 1 wt. % rare earth exchange, a dealuminated zeolite content of about 30 wt. % in an active matrix component and a MAT activity of 68. The catalyst was passed from the regenerator to the riser at a temperature of about 1321° F. The feed and catalyst mixture passed through the riser at an average temperature of 970° F. for an average time of three seconds and was discharged directly into a reactor vessel. Separated catalyst from the cyclone was discharged into a subadjacent stripping zone and contacted with a stripping steam at conditions that maintained an average stripping zone temperature of 970° F. Vapors removed from the catalyst in the stripping zone were vented into the reactor vessel and withdrawn through a first cyclone that operates in closed communication with the second cyclone to recover product vapors from the reactor vessel. Additional amounts of catalyst particles separated from the product vapors by the cyclones were discharged into the stripping zone. A vapor line carried all of the product vapors from the second stage cyclone to a main column fractionator. The cooled vapors had the composition set forth in Table 2.

EXAMPLE 2

In a first light olefin case, a feed again having the composition as set forth in the Table 1 was charged to a riser and contacted with a low rare earth catalyst having less than 1 wt. % rare earth exchange, a dealuminated zeolite content of about 30 wt. % in an active matrix component and a MAT activity of 68. The catalyst was passed from the regenerator at a temperature of 1350° F. The feed and catalyst mixture passed through the riser for an average riser residence time of three seconds and was discharged from the riser outlet at an average temperature of 1025° F. directly into the first stage of a cyclone separator. Separated catalyst from the first stage cyclone dropped into a subadjacent stripping zone and into contact with a stripping steam at conditions that maintained an average stripping zone temperature of 1100° F. Vapors removed from the catalyst in the stripping zone were vented into a second stage of the cyclone separator that also received, in closed communication, vapors recovered from the first cyclone. Additional amounts of catalyst particles were separated from the product and stripping gases by the second cyclone stage and discharged into the stripping zone. All of the vapor from the second stage cyclone was discharged directly into a quench zone. The quench zone contacted the vapors from the second stage cyclone with cycle oil from the main column fractionator that cooled the product vapors to a temperature of 800° F. The cooled vapors had the composition set forth in Table 2.

EXAMPLES 3

In a second light olefin case, a feed again having the composition as set forth in the Table 1 was charged to a riser and contacted with a low rare earth catalyst having less than 1 wt. % rare earth exchange, a dealuminated zeolite content of about 40 wt. % in an active matrix component and a MAT activity of 72. The catalyst was passed from the regenerator at a temperature of 1351° F. The feed and catalyst mixture passed through the riser for an average riser residence time of three seconds and was discharged from the riser outlet at an average temperature of 1025° F. directly into the first stage of a cyclone separator. Separated catalyst from the first stage cyclone dropped into a subadjacent stripping zone and into contact with a stripping steam at conditions that maintained an average stripping zone temperature of 1100° F. Vapors removed from the catalyst in the stripping zone were vented into a second stage of the cyclone separator that also received, in closed communication, vapors recovered from the first cyclone. Additional amounts of catalyst particles were separated from the product and stripping gases by the second cyclone stage and discharged into the stripping zone. All of the vapor from the second stage cyclone was discharged directly into a quench zone. The quench zone contacted the vapors from the second stage cyclone with cycle oil from the main column fractionator that cooled the product vapors to a temperature of 800° F. The cooled vapors had the composition set forth in Table 2.

As compared to the base case, the data demonstrates that the high temperature operation, direct discharge of the riser effluent into the cyclone system, the hot stripping operation, and the immediate quenching of the reactor products after discharge from the cyclones provide significant yield advantages for the first light olefin case both in terms of conversion, olefin production and gasoline octane. The conversion, olefin and gasoline octane advantages more than offset the slightly higher coke and light gas production obtained by the process of this invention as compared to the prior art process.

Further improvements in conversion, olefin product and gasoline octane were obtained by the use of a slightly more active catalyst. The rapid quenching and quick quench of this invention permits the beneficial use of a more active catalyst.

TABLE 1

| | |
|---|---|
| API | 23.41 |
| UOP MOLECULAR K | 11.73 |
| WT. | 361.5 |
| NICKEL, PPM | 0.55 |
| VANADIUM, PPM | 0.60 |
| SULFUR, WT. % | 2.38 |
| RAMMSBOTTOM CARBON, WT. % | 0.70 |
| PERCENT BOILING AT 650° F. | 0.0 |

TABLE 2

| | Example 1 Base Case | Example 2 Light Olefin Case #1 | Example 3 Light Olefin Case #2 |
|---|---|---|---|
| Conversion, LV % | 75.9 | 80.4 | 83.0 |
| YIELDS, LV % on FEED | | | |
| $C_3$= | 7.8 | 10.5 | 12.5 |
| $C_3$ | 2.8 | 3.1 | 3.5 |
| $C_3$=/$C_3$ | 0.74 | .77 | 0.78 |
| $C_4$= | 8.5 | 12.2 | 13.9 |
| $C_4$ | 6.0 | 7.1 | 6.5 |
| $C_4$=/$C_4$ | 0.58 | .63 | 0.68 |
| $C_5$= | 6.6 | 7.1 | 7.8 |
| $C_5$ | 5.0 | 4.3 | 4.3 |
| $C_5$=/$C_5$ | 0.57 | .62 | 0.64 |
| $C_5$+ Gasoline | 58.1 | 55.6 | 54.9 |
| LCO + MCB | 24.5 | 19.6 | 17.0 |
| Coke, wt. % | 5.1 | 6.02 | 6.4 |
| $C_2$ minus, wt. % | 3.6 | 4.43 | 4.65 |
| $C_5$+ Gasoline | | | |
| RON | 92.6 | 94.0 | 94.8 |
| MON | 80.0 | 81.8 | 82.1 |

What is claimed is:

1. A process for the fluid catalytic cracking of hydrocarbons, said process comprising:

(a) passing regenerated catalyst particles into the upstream portion of a riser conversion zone and accelerating said catalyst particles by contact with a lift gas to a gas velocity of at least 1.2 meters per second;

(b) injecting a hydrocarbon feed into said riser at a point downstream from the point of lift gas addition in an amount sufficient to maintain an average temperature of at least 550° C. (1025° F.) in said riser and contacting said feed and catalyst in said riser for 0.2 to 5 seconds to convert at least a portion of said feed to a conversion stream comprising conversion products;

(c) directing said conversion stream and catalyst out of said riser and directly into a cyclone separator without substantial cooling of said catalyst particles and substantially separating said conversion products from said catalyst particles;

(d) passing catalyst particles having absorbed hydrocarbons from said separator into a catalyst stripping zone and maintaining a temperature in said stripping zone of at least 525° C. (975° F.);

(e) returning hydrocarbons from said stripping zone to said cyclone separator;

(f) transferring conversion products directly from said cyclone separator into contact with a quench medium and reducing the temperature of said conversion products to a temperature of less than 500° C. (930° F.);

(g) separating the said conversion products and quench liquid to recover at least one FCC product stream; and (h) removing spent catalyst from said stripping zone for regeneration.

2. The process of claim 1 wherein a diluent material is mixed with said conversion stream upstream and at the end of the riser conversion zone of the cyclone separator to reduce the partial pressure of said stream, said diluent being added at a temperature and in a quantity that will not substantially reduce the temperature of said conversion stream.

3. The process of claim 1 wherein said stripping zone is maintained at a higher pressure than the internal pressure of said cyclone separator.

4. The process of claim 1 wherein conversion products are quenched by directly communicating said vapor outlet of said cyclone separator with a quench vessel having a continuous circulation of a substantial liquid volume of heavy hydrocarbons.

5. The process of claim 1 wherein hot regenerated catalyst is added to said stripping zone in step (d) to heat said catalyst particles from said separator.

6. The process of claim 1 wherein said catalyst particles in step (d) are heated by contact with hot catalyst particles.

7. The process of claim 1 wherein hydrocarbons are returned to said separator from said stripping zone by addition to the inlet of said separator.

8. The process of claim 3 wherein hydrocarbons are returned from said stripping zone to said separator through a restricted flow passage that creates a pressure drop between its inlet and outlet.

9. The process of claim 1 wherein said first mentioned cyclone separator passes separated conversion products directly into a secondary cyclone separator.

* * * * *